United States Patent [19]

Kawai et al.

[11] 4,307,146

[45] Dec. 22, 1981

[54] PROCESS FOR RESIN-FINISHING OF TEXTILE FABRICS AND KNITTED GOODS

[75] Inventors: Eiichi Kawai, Takatsuki; Takeo Matsui, Suita; Kozo Kawata, Sakai; Hisao Takagishi, Kyoto, all of Japan

[73] Assignee: Sumitomo Chemical Company, Limited, Osaka, Japan

[21] Appl. No.: 136,118

[22] Filed: Mar. 27, 1980

[30] Foreign Application Priority Data

Apr. 2, 1979 [JP] Japan ..... 54-40028

[51] Int. Cl.[3] ..... D06M 13/34; B32B 7/00; B32B 27/42; B05D 1/18

[52] U.S. Cl. ..... 428/264; 8/183; 8/186; 427/393.2; 427/439; 428/265; 428/278

[58] Field of Search ..... 427/393.2, 439; 8/183, 8/186; 428/264, 265, 278

[56] References Cited

U.S. PATENT DOCUMENTS

| | | | |
|---|---|---|---|
| 3,627,556 | 12/1971 | Roth et al. | 427/393.2 X |
| 3,936,561 | 12/1976 | Cotton | 427/393.2 X |
| 4,198,462 | 4/1980 | Dixon et al. | 427/393.2 X |

OTHER PUBLICATIONS

*Activated Recurable Cotton Durable Press Fabrics*, Franklin, Wm. E. et al, Mar., 1974, pp. 29–33.

*Primary Examiner*—Michael R. Lusignan
*Attorney, Agent, or Firm*—Cushman, Darby & Cushman

[57] ABSTRACT

Cotton-polyester fiber-blended textile fabrics and knitted goods are resin-finished to be imparted with a high soft feeling and a durable crease resistance using a resin bath containing a specific combination of an amino resin having in the molecule at least two N-methylol groups which may be partially or wholly alkylated, a diol type surface active agent and an acid catalyst for cross-linkage.

7 Claims, No Drawings

PROCESS FOR RESIN-FINISHING OF TEXTILE FABRICS AND KNITTED GOODS

The present invention relates to a process for resin-finishing cotton and polyester fiber-blended textile fabrics and knitted goods to impart a soft feeling and a high crease resistance to them.

In order for imparting a durable crease resistance to the cotton and polyester fiber-blended textile fabrics and knitted goods (hereinafter referred to as "cotton-polyester blends" for brevity), there has heretofore been applied a process comprising using as a treating agent a so-called cellulose-reactive resin which is a reaction product of alkyleneureas, hydroxyethyleneurea (glyoxalurea), triazone, triazine, alkylcarbamates or the like with formaldehyde. Particularly, glyoxal resins have been widely used because they are high in the anticrease effect with excellent durability, and excellent in a hydrolysis resistance to diminish the generation of formaldehyde to be released from the final goods, and moreover there can be omitted a soaping step in the final finishing processes, which has been inevitably required in a conventional resin-finishing.

In recent years, however, as for the finished cotton-polyester blends, a soft feeling has been favored rather than a hard feeling, and therefore it has been strongly required to soften the feeling.

As described above, various advantages can be given by the use of glyoxal resins, whereas the feeling imparted at that time is, in general, hard, and thus they are not always satisfactory.

On the other hand, in order for soft-finishing textile fabrics and knitted goods, it is also known to use dimethylol ethyleneurea, dimethylol propyleneurea, dimethylol alkylcarbamates or the like as a treating agent. In this case, however, there are problems such that even if a soft feeling can be imparted to the final goods, a durability in the anticrease effect is so inferior that the resin bonded to the fiber is readily hydrolyzed to release formaldehyde from the final goods, causing the generation of unfavorable order.

In addition, it has been proposed to prevent hardening of the feeling by subjecting N-methylol group-containing amino resins to esterification or the like in order to modify the N-methylol group. However, the said modification is usually carried out under acidic conditions, and thus a condensation polymerization of the resin can occur simultaneously to diminish the effect. In this respect, it is also known to use an emulsion softening agent of polyethylene, silicone or the like series or a softening agent of fatty acids or derivatives thereof together with amino resins having partially or wholly methoxymethylated N-methylol group, but the degree of softening and the durability thereof are still insufficient and not always satisfactory.

The present inventors have earnestly studied to solve the said problems, and found that a particular combination of the foregoing glyoxal resins with a specific surface active agent and a cross-linking catalyst can impart a desired soft feeling and a high crease resistance with an excellent durability at the same time to the cotton-polyester blends.

The present invention provides a process for resin-finishing cotton-polyester fiber-blends, which comprises immersing the cotton-polyester blends into an aqueous solution containing an amino resin having in the molecule at least two N-methylol groups which may be partially or wholly alkylated, a diol type surface active agent and an acid catalyst for cross-linkage, and heat-treating the cotton-polyester blends immersed with the aqueous solution.

The amino resin usable in the process of the present invention includes an N-methylolated compound of alkyleneureas, alkyltriazones or derivatives thereof, urones, alkylcarbamates, triazines, glyoxalureines and the like, which compound has in the molecule at least two N-methylol groups which may be partially or wholly alkylated. Of these, those which are apt to have a three-dimensional structure by the condensation polymerization are particularly preferred. More specifically, the preferred includes N,N'-dimethylol-4,5-dihydroxy-2-imidazolidinone and methoxymethylated compounds including N-methylol-N'-methoxymethyl-4,5-dihydroxy-2-imidazolidinone, N-methylol-N'-methoxymethyl-4-methoxy-5-hydroxy-2-imidazolidinone and the like.

The diol type surface active agent usable in the present process includes those which are miscible with water to form a transparent complete solution and capable of reacting with the methylol or methoxymethyl group of the above amino resin. More specifically, it includes alkylamine- or alkylamide-polyalkylene oxide adducts, and polymers of polyalkylene glycols. Of these, the preferred are the polymers of polyalkylene glycols. More specifically, the preferred is a nonionic surface active agent having polypropylene glycol and polyethylene glycol as the hydrophobic group and the hydrophilic group, respectively, the weight ratio of the polyethylene glycol to the polypropylene glycol being 20 to 85:80 to 15, and the molecular weight being about 2,500 to about 13,000. The solubility in water is increased with increase in the ratio of the polyethylene glycol, and the softening of feeling is increased with increase in the ratio of the polypropylene glycol and the molecular weight. Moreover, adhesibility of the treating agent to the fiber is increased with increase in the molecular weight. From the above consideration, the most preferred is a surface active agent having 30 to 50:70 to 50 in the weight ratio of the polyethylene glycol to the polypropylene glycol, and about 5,000 in the molecular weight.

The weight ratio of the amino resin to the diol type surface active agent ranges from 99:1 to 60:40.

In the present invention, it is considered that the desired effects can be attained due to the insolubilization brought about by the linkage between the diol type surface active agent and the N-methylol group or the N-alkoxymethyl group contained in the amino resin during a heat treatment.

The acid catalyst for cross-linkage usable in the present process includes those which have been used usually in a conventional resin-finishing of fibers. Examples of the catalysts are metal salts of mineral acids, e.g. magnesium chloride, zinc nitrate, borofluorides and the like, ammonium salts of mineral acids, e.g. ammonium phosphate, ammonium chloride and the like, and they can be used each alone or in admixture thereof. If necessary, inorganic acids such as hydrochloric acid, sulfuric acid and the like, and organic acids such as citric acid, tartaric acid, malic acid, maleic acid and the like may be incorporated into the said catalyst. The amount of the catalyst to be used is not particularly limited, but is usually from 5 to 20% by weight based on the weight of the amino resin.

The aforesaid amino resin, diol type surface active agent and acid catalyst are dissolved in water to prepare a resin solution.

In the preparation of the resin solution, an aqueous solution of the amino resin may be blended in advance with the diol type surface active agent to prepare a resin solution, which may be blended with the acid catalyst at the time of resin-finishing of the fiber. The resin solution is transparent and easy in handling. The resin content in the resin solution is not particularly limited, but usually 30 to 60% by weight.

In carrying out the resin-finishing in accordance with the present invention, a resin bath is prepared using the resin solution in an amount of 5 to 20% by weight based on the volume of the resin bath. The resin bath may further contain other additives, such as higher fatty acid derivatives or silicone series softening agents in an amount to be used usually in a conventional resin-finishing. Using the resin bath thus prepared, the cotton-polyester blend can be resin-finished in a conventional manner. For example, the cotton-polyester blends are immersed in the resin bath, squeezed up to about 50 to 100% in pick-up, if desired predried at a temperature of about 80° to 120° C. for 1 to 3 minutes, and then cured at a temperature of about 130° to 170° C. for 30 seconds to 5 minutes.

As for the cotton-polyester blends to be finished in accordance with the present invention, those which have 50% by weight or more of polyester in the blending ratio are particularly preferably used, whereby a superior effect can be attained.

According to the process of the present invention, the cotton-polyester blends can be imparted with a highly soft feeling which is superior to that inherent in the blends per se, and a high crease resistance with an excellent durability, and moreover with a soil release property.

The present invention is illustrated in more detail with reference to the following Examples, which are only illustrative and are not intended to limit the scope of the present invention. In Examples, % is by weight, and the stiffness and crease resistance were measured according to Handle-O-meter method as per JIS L-1004 (Total Hand), and Monsanto's method as per JIS L-1004 B.

EXAMPLE 1

To a solution of 15 g of a 40% aqueous N-methylol-N'-methoxymethyl-4-methoxy-5-hydroxy-2-imidazolidinone solution and 0.6 g of Epan U-103 (a diol type surface active agent having a polyethylene glycol/polypropylene glycol weight ratio of 30/70, and a molecular weight of about 4,600, produced by Dai-ichi Kogyo Seiyaku Co.) was added 0.54 g of a mixture of magnesium chloride and ammonium sulfate in a mixing weight ratio of 5:1, and the mixture was diluted with water to make the volume 100 cc, thereby obtaining a resin bath.

A blended broad cloth (polyester/cotton being 65/35) was immersed in the resin bath, squeezed up to 65% in pick-up, pre-dried at 105° C. for 2 minutes, and then cured at 150° C. for 3 minutes.

The stiffness and the crease resistance of the finished cloth were measured. The results are as shown in Table 1.

For the comparison purpose, the above procedure was repeated, provided that Epan U-103 was not used. The results are as shown also in Table 1.

TABLE 1

| Finishing process | Stiffness (g/10 mm) | Crease resistance (W + F)°* |
|---|---|---|
| Process of the present invention | 119 | 300 |
| Comparative process | 152 | 302 |
| Blank test | 129 | 270 |

*(W + F)° means a sum of crease recovery angles of warp and weft in tested cloth.

EXAMPLE 2

To a solution of 15 g of a 40% aqueous N,N'-dimethylol-4,5-dihydroxy-2-imidazolidinone solution and 4 g of Epan-785 (a diol type surface active agent having a polyethylene glycol/polypropylene glycol weight ratio of 85/15, and a molecular weight of about 13,000, produced by Dai-ichi Kogyo Seiyaku Co.) was added 0.54 g of a mixture of magnesium chloride and ammonium sulfate in a weight ratio of 5:1, and the mixture was diluted with water to make the volume 100 cc, thereby obtaining a resin bath. Using the resulting resin bath, the polyester-cotton blended broad cloth was finished in the same manner as in Example 1. The stiffness and the crease resistance of the finished cloth were measured, and the results are as shown in Table 2. For the comparison purpose, the above procedure was repeated, provided that Epan-785 was not used. The results are as shown also in Table 2.

TABLE 2

| Finishing process | Stiffness (g/10 mm) | Crease resistance (W + F)° |
|---|---|---|
| Process of the present invention | 125 | 313 |
| Comparative process | 210 | 316 |
| Blank test | 117 | 274 |

EXAMPLE 3

To a solution of 15 g of a 40% aqueous solution of N-methylol-N'-methoxymethyl-4,5-dihydroxy-2-imidazolidinone, and 4- and 5-positioned hydroxy of which had been methylated at a methylation degree of 50%, and 0.6 g of Epan-740 (a diol type surface active agent having a polyethylene glycol/polypropylene glycol weight ratio of 40/60, and a molecular weight of about 3,300, produced by Dai-ichi Kogyo Seiyaku Co.) were added 0.54 g of a mixture of magnesium chloride and ammonium sulfate in a weight ratio of 5:1, and 0.02 g of ammonium primary phosphate, and the mixture was diluted with water to make the volume 100 cc, thereby obtaining a resin bath. Using the resulting resin bath, the polyester-cotton blended broad cloth was finished in the same manner as in Example 1. The stiffness and the crease resistance of the finished cloth were measured, and the results are as shown in Table 3. For the comparison purpose, the above procedure was repeated, provided that Epan-740 was not used. The results are as shown also in Table 3.

TABLE 3

| Finishing process | Stiffness (g/10 mm) | Crease resistance (W + F)° |
|---|---|---|
| Process of the present invention | 124 | 302 |
| Comparative process | 187 | 302 |
| Blank test | 130 | 272 |

EXAMPLE 4

To a solution of 15 g of a 40% aqueous N-methylol-N'-methoxymethyl-4-methoxy-5-hydroxy-2-imidazolidinone solution and 0.06 g of Epan-785 (as defined above) was added 0.54 g of a mixture of magnesium chloride and ammonium sulfate in a weight ratio of 5:1, and the mixture was diluted with water to make the volume 100 cc, thereby obtaining a resin bath. Using the resin bath, the polyester-cotton blended broad cloth was finished in the same manner as in Example 1. The stiffness and the crease resistance of the finished cloth were measured and the results are as shown in Table 4. For the comparison purpose, the above, procedure was repeated, provided that Epan-785 was not used. The results are as shown in Table 4.

TABLE 4

| Finishing process | Stiffness (g/10 mm) | Crease resistance (W + F)° |
|---|---|---|
| Process of the present invention | 136 | 302 |
| Comparative process | 152 | 302 |
| Blank test | 129 | 270 |

EXAMPLE 5

To a solution of 15 g of a 40% aqueous solution of N-methylol-N'-methoxymethyl-4,5-dihydroxy-2-imidazolidinone, the 4- and 5-positioned hydroxy of which had been methylated to a methylation degree of 50%, and 0.66 g of Epan U-105 (a diol type surface active agent having a polyethylene glycol/polypropylene glycol weight ratio of 50/50, and a molecular weight of about 6,400, produced by Dai-ichi Kogyo Seiyaku Co.) was added 0.54 g of a mixture of magnesium chloride and citric acid in a weight ratio of 9:1, and the mixture was diluted with water to make the volume 100 cc, thereby obtaining a resin bath. Using the resulting resin bath, the polyester-cotton blended broad cloth was finished in the same manner as in Example 1. The stiffness and the crease resistance of the finished cloth were measured, and the results are as shown in Table 5. For the comparison purpose, the above procedure was repeated, provided that Epan U-105 was not used. The results are as shown also in Table 5.

TABLE 5

| Finishing process | Stiffness (g/10 mm) | Crease resistance (W + F)° |
|---|---|---|
| Process of the present invention | 126 | 300 |
| Comparative process | 187 | 302 |
| Blank test | 130 | 272 |

EXAMPLE 6

To a solution of 10 g of a 40% aqueous N-methylol-N'-methoxymethyl-4-methoxy-5-hydroxy-2-imidazolidinone solution and 0.4 g of Epan U-103 (as defined above) were added 0.36 g of a mixture of magnesium chloride and ammonium sulfate in a weight ratio of 5:1 and 3 g of Sumitex Softener LK-1 (a higher fatty acid derivative softening agent, produced by Sumitomo Chemical Company, Limited), and the resulting mixture was diluted with water to make the volume 100 cc, thereby obtaining a resin bath. Using the resin bath, the polyester-cotton blended broad cloth was finished in the same manner as in Example 1. The stiffness and the crease resistance were measured, and the results are as shown in Table 6. For the comparison purpose, the above procedure was repeated provided that Sumitex Softener LK-1 was not used. The results are as shown also in Table 6.

TABLE 6

| Finishing process | Stiffness (g/10 mm) | Crease resistance (W + F)° |
|---|---|---|
| Process of the present invention (additional softening agent was used) | 104 | 304 |
| Process of the present invention (no additional softening agent was used) | 107 | 295 |
| Blank test | 117 | 272 |

We claim:

1. A process for resin-finishing cotton-polyester fiber-blended textile fabrics and knitted goods, which comprises immersing the fabrics and knitted goods into an aqueous solution containing an amino resin having in the molecule at least two N-methylol groups which may be partially or wholly alkylated, a diol type surface active agent which is nonionic surface active agent having polypropylene glycol and polyethylene glycol as the hydrophobic group and hydrophilic group, respectively and the weight ratio of the polyethylene glycol to the polypropylene glycol being 20 to 85:80 to 15, and the molecular weight being about 2,500 to 13,000 and an acid catalyst for cross-linkage, and heat-treating the fabric and knitted goods immersed with the aqueous solution.

2. A process for resin-finishing cotton-polyester fiber-blended textile fabrics and knitted goods, which comprises immersing the fabrics and knitted goods into an aqueous solution containing an amino resin having in the molecule at least two N-methylol groups which may be partially or wholly alkylated, a diol type surface active agent which is nonionic surface active agent having polypropylene glycol and polyethylene glycol as the hydrophobic group and the hydrophilic group, respectively and an acid catalyst for cross-linkage, the weight ratio of the amino resin to the nonionic surface active agent being 99:1 to 60:40, and heat-treating the fabrics and knitted goods immersed with the aqueous solution.

3. A process according to claim 1, wherein the amino resin is an N-methylolated compound of alkyleneureas, alkyltriazones or derivatives thereof, urones, alkylcarbamates or triazines, or glyoxalureines.

4. A process according to claim 1, wherein the amino resin is N,N'-dimethylol-4,5-dihydroxy-2-imidazolidinone or a methoxymethylolated compound thereof.

5. A process according to claim 1, wherein the fabrics and knitted goods immersed with the aqueous solution are squeezed up to about 50 to 100% in pick-up prior to the heat-treating.

6. A process according to claim 1, wherein the acid catalyst is at least one member selected from metal salts of mineral acids and ammonium salts of mineral acids.

7. Cotton and polyester fiber-blended textile fabrics and knitted goods resin-finished by the process of claim 1.

* * * * *